United States Patent [19]

Fisch et al.

[11] 4,156,604

[45] May 29, 1979

[54] CONTROLLED DELIVERY OF CORROSION INHIBITORS FOR SILVER RECOVERY CARTRIDGES

[75] Inventors: Richard S. Fisch; Norman Newman, both of St. Paul, Minn.

[73] Assignee: Minnesota Mining and Manufacturing Company, St. Paul, Minn.

[21] Appl. No.: 942,477

[22] Filed: Sep. 15, 1978

[51] Int. Cl.[2] ..... C22B 11/04

[52] U.S. Cl. ..... 75/109; 75/118 R; 75/118 P; 266/170

[58] Field of Search ..... 266/170; 75/109, 118 R, 75/118 P

[56] References Cited

U.S. PATENT DOCUMENTS

| | | | |
|---|---|---|---|
| 2,214,765 | 9/1940 | Holzwarth | 75/109 |
| 3,255,128 | 6/1966 | Farkas et al. | 75/101 BE X |
| 3,369,801 | 2/1968 | Hartman | 75/118 P |
| 3,705,938 | 12/1972 | Hyman et al. | 424/19 |
| 3,814,809 | 6/1974 | Gordon | 424/19 |
| 3,816,321 | 6/1974 | Kleinschmidt | 252/134 |
| 3,816,322 | 6/1974 | Griffin et al. | 252/147 |
| 3,847,722 | 11/1974 | Kistner | 161/109 |
| 3,905,923 | 9/1975 | Klug | 260/2.5 AD |
| 3,923,939 | 12/1975 | Baker et al. | 264/49 |
| 4,035,181 | 7/1977 | Fisch | 75/109 |

FOREIGN PATENT DOCUMENTS 1429711 3/1976 United Kingdom.

*Primary Examiner*—G. Ozaki

*Attorney, Agent, or Firm*—Cruzan Alexander; Donald M. Sell; Mark A. Litman

[57] ABSTRACT

A method for controlled delivery of corrosion inhibitors to a silver containing solution in a silver recovery device which utilizes a metallic fill for electron exchange. The method involves forming a structure of polyurethane foam within which a corrosion inhibitor is incorporated and placing the structure in the silver recovery device.

5 Claims, 1 Drawing Figure

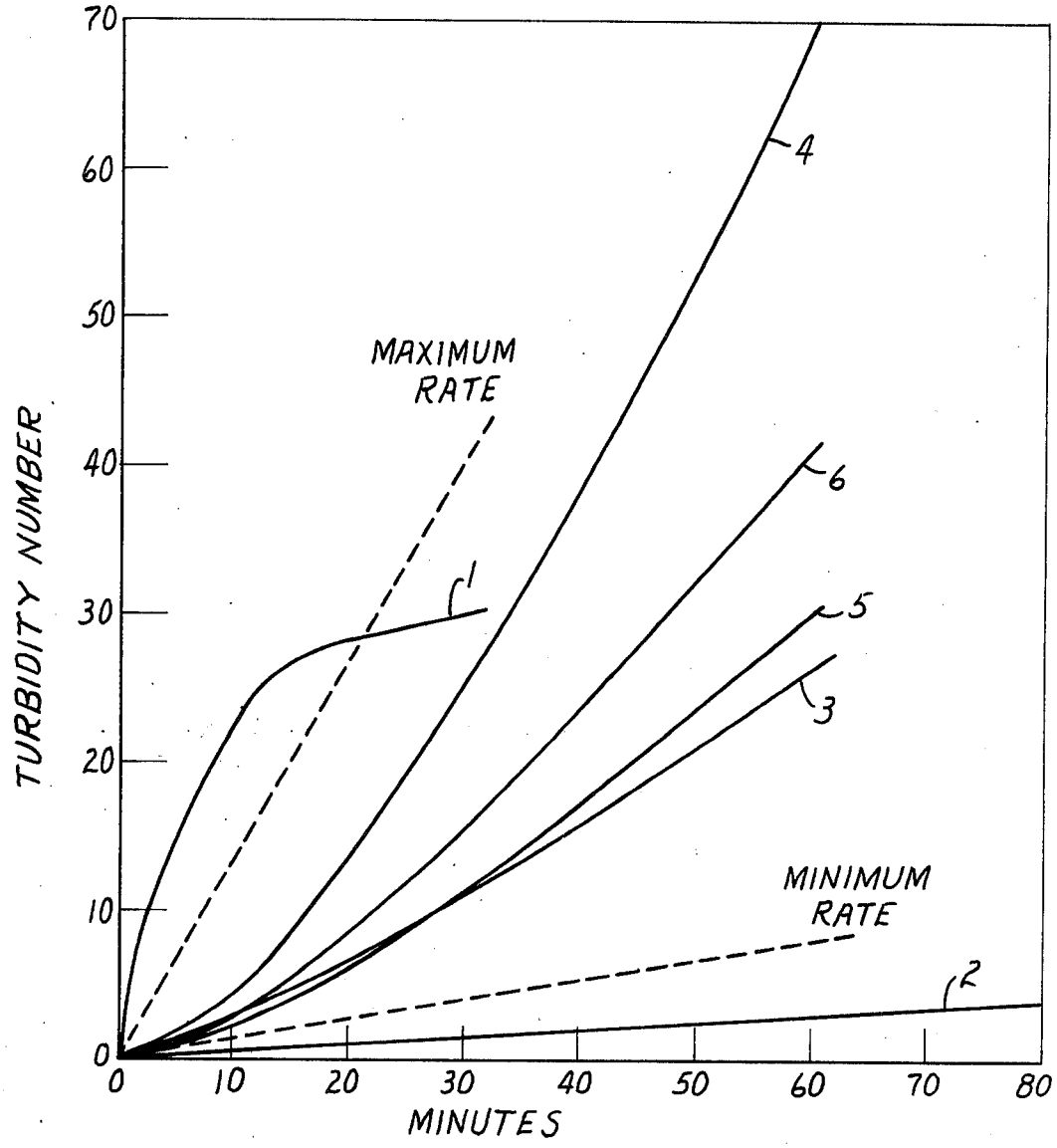
70
60
50
40
30
20
10
0
TURBIDITY NUMBER
0
10
20
30
40
50
60
70
80
MINUTES
MAXIMUM RATE
MINIMUM RATE
1
2
3
4
5
6

CONTROLLED DELIVERY OF CORROSION INHIBITORS FOR SILVER RECOVERY CARTRIDGES

FIELD OF THE INVENTION

The invention relates to a method for controlling the delivery of a corrosion inhibitor in the silver recovery unit of a photographic processing system.

BACKGROUND OF THE INVENTION

During the processing of silver halide photographic materials, silver is carried out of the photographic elements and into solutions, particularly the fix and bleach-/fix solutions. Numerous devices have been developed for removing the silver from the spent solutions. One such device utilizes a container within which is positioned a metallic filler, e.g., U.S. Pat. No. 3,369,801. The container is connected to the photographic processing unit, resulting in the spent silver containing solution flowing completely through the container holding the metallic filler prior to the solution being sewered or returned to a fixing tank. While the solution is being circulated, the silver is deposited as a sludge in the container.

This type of system utilizes an electron exchange which occurs between the more and less noble metal in order to recover the silver in the spent solution. The less noble metal in this type of recovery unit is iron in the form of inexpensive steel wool. When the silver rich solution is passed over the iron, an electron exchange occurs wherein the iron metal $Fe^{\circ}$ is oxidized to ferrous or ferric ion and the silver ion ($Ag^{+}$) is reduced to silver metal ($Ag^{\circ}$). The silver precipitates from the solution with some unreacted or oxidized iron, to form the above-mentioned sludge.

The iron or steel wool sits in a water based solution during dormant periods of such a process, i.e., overnight shut-down. Present experience shows that iron in surprisingly large quantities is being brought into solution. There is more iron brought into solution than would be expected from the stoichiometry of the metal displacement silver recovery reaction. To combat this transfer of iron during these dormant periods, certain materials, such as those described in U.S. Pat. No. 4,035,181, when added to the silver rich solution, have been found to reduce the non-productive amounts of iron being brought into solution during these dormant periods.

Although these materials are effective for their intended purpose, special care has to be taken to ensure that excess quantities of inhibitor are not introduced that would tend to retard the desired metal ion exchange reactions once the processing was restarted. Methods of introduction in similar situations have included hand measuring and automatic metering. Addition of inhibitor by hand not only is inconvenient in an automatic process but allows for the introduction of operator error during the measuring. Automatic metering devices solve the above mentioned problems that result when inhibitor is introduced by hand, but such metering devices involve a more complicated apparatus that has a higher likelihood of mechanical failure.

Also automatic metering devices have been found costly from the standpoint of not only the initial purchase but also the maintenance of such a complicated apparatus. This is in contrast to the low cost associated with the device disclosed herein.

In the present invention, the inhibitor is released slowly by diffusion resulting in a small amount of inhibitor being delivered to the flowing stream during the active silver recovery period. The diffusion mechanism also maintains the necessary amount of inhibitor to protect the metallic filler, such as steel wool, during the quiescent period. This results in a considerably improved efficiency of utilization of inhibitor, reducing the amount of inhibitor required to well below 10% of the amount which would otherwise be necessary.

SUMMARY OF THE INVENTION

According to the present invention, a method has been found for delivering the corrosion inhibiting material to the silver solution without the problems of mechanical failure or operator error. This method may be briefly described as comprising the steps of forming a structure of polyurethane foam in which the corrosion inhibitor has been incorporated therein during the foaming process. After formation, the structure is then placed into the silver recovery device. The formed foam structure results in a cell structure which allows the corrosive inhibitor to be released into the dormant silver solution at a rate which would yield a turbidity number (as defined below) of between about 8 in 60 minutes to about 20 in 15 minutes.

Turbidity number is used herein to be the absorbance of a solution multiplied by 100. Absorbance is measured utilizing water as the solvent. A previously presoaked (1 hour) inhibitor carrier is placed in the solvent. Readings of aliquots of the solution treated with phosphotungstic acid are taken in a 1 cm quartz cell with reading being taken at a wavelength of 400 nm at 20° C.

DESCRIPTION OF DRAWING

The FIGURE represents the graphical results of the turbidity over time of articles made in accordance with the present invention.

DETAILED DESCRIPTION OF THE INVENTION

It has been found that the inhibitor can be programmed to release at a desired rate by the choice of carrier in which it is placed. Carriers such as sawdust, sponge, and cardboard can be utilized but fail to give the needed delivery rate over a long period of time. The preferred material for use as a carrier is a polyurethane material, with a hydrophilic polyurethane prepolymer being most preferred because of its ability to control as required the diffusion of the inhibitor, which is formed in situ, into the spent fixer.

The material which inhibits the corrosion and hydrogen embrittlement of the metallic filler is incorporated into the foam structure during the foaming process. This material is selected from the classes of substituted quanternary ammonium chlorides, amines, phosphates and polyethylene oxides (e.g., see U.S. Pat. No. 4,035,181). Also materials disclosed in U.S. Pat. No. 4,110,109 having no more than 50 carbon atoms and being represented by either of the formulae:

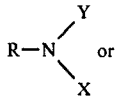

or (I)

-continued

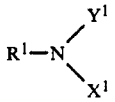

(II)

wherein R and $R^1$ are abietyl, hydroabietyl, dehydroabietyl, or $C_4$–$C_{20}$ alkyl, X is H or $—CH_2A$, Y is $—CH_2A$, and A is an alpha ketonyl group $X^1$ and $Y^1$ are $—CH_2CH_2O)_mH$ and $—CH_2CH_2O)_nH$ respectively wherein m+n is at least 1 and m and n may each be 0 to 15, have been found useful in the present invention.

Inhibitors which are especially useful with a hydrophilic foam of the type described in British Pat. No. 1,429,711 include dimethyl di(hydrogenated tallow) ammonium chloride, dehydroabietylamine, sodium salt of N-coco beta amino propionate, Armohib 31 (a product of Armak Ind. Chem Co. consisting of an amine ethylene oxide adduct, dibutyl thiourea and surfactant solubilizers), ethoxylated amine, Rodine 213 commercially available from Amchem Co. (a Mannich reaction product of an abietyl amine, ketone and formaldehyde which is described by formula II above, plus surfactants) modified alkyl poly(ethylenoxy)-glycol amide, $RC_6H_4O(CH_2CH_2O)_n$-$CH_2CH_2OH$ (imidazoline), heterocyclic tertiary amine (e.g., where R=nonyl), polyoxyethylene, polyethylene glycol mono fatty acid ester, and polyoxyethylene (20) oleylether.

Although the foam structure may be shaped in any manner, it is preferably shaped to form a disk having a hole centrally disposed. With such a hole, the disk may be positioned within the metallic filler container (cartridge) without inhibiting the flow of a solution through the container during processing. Alternatively a prepolymer containing an inhibitor may be poured onto the metallic filler and the foaming then done in place or allowed to take place with moisture in the air or with the first spent solution passing through the cartridge. It has been found that such inplace foaming aids in the prevention of the collapse of the metallic filler upon its exhaustion. Prior to this invention the collapse of filler would tend to clog the silver recovery unit.

The following examples outline means for determining the effective range of inhibitor delivery rates from polyurethane foams.

EXAMPLES 1–6

In each example, 2 milliliters of Hypol FHP 2000, (an oxyethylene rich polyether polyol containing no ester and having TDI functionality commercially available from W. R. Grace and Co.) was placed in the bottom of an 80 milliliter beaker having a 4 cm diameter which was previously sprayed with a silicone release agent. Distilled water, in amounts stated in the table below, was added to the beaker and the contents were mixed vigorously with a spatula. When the mixture began to foam, 0.5 ml of Igepal CO-610 (non-ionic surfactant having a structure of $RC_6H_4O(CH_2CH_2O)_nCH_2CH_2OH$ wherein R=nonyl and n=9 or 10) was added and mixing was continued until uniformity was achieved. The contents of the beaker was allowed to set for approximately 10 minutes until a non-tacky disk formed. The disk was then removed and suspended in a beaker containing 250 mls of distilled water and a magnetic stirrer of 1 cm diameter and 4 cm length.

The disk was preleached by activating the magnetic stirrer at 288 revolutions per minute at ambient temperature of approximately 20° C. for 1 hour. The water was then replaced and the magnetic stirrer was started. The concentration of Igepal CO-610 which was delivered into the water was determined by withdrawing a 10 ml sample and adding it to 30 mls of 0.5% phosphotungstic acid in a 50 ml beaker. The turbidity of the sample was then calculated by measuring the absorbance in a 1 cm quartz cell at a wavelength of 400 nm, then multiplying this number by 100.

Disks of the following compositions were prepared:

| Ex. No. | Hypol FHP 2000 (ml) | Water (ml) | Igepal CO-610 (ml) |
|---|---|---|---|
| 1 | "2 lb." open-celled polyurethane | | 0.5 |
| 2 | 2 | 0.1 | 0.5 |
| 3 | 2 | 0.2 | 0.5 |
| 4 | 2 | 2 | 0.5 |
| 5 | 2 | 5 | 0.5 |
| 6 | 2 | 10 | 0.5 |

The data are graphed in the FIGURE. It is found that the useful range of Hypol/water ratios varies from 10 to 0.2, (e.g., lines designated 3, 4, 5, 6 corresponding to the formulation in each example). A foam structure which is a result of a reactant ratio of 20:1 (Example 2 and line 2) has too low a delivery rate to replenish the inhibitor during the stationary period of cartridge use, while a fully open-celled foam (e.g., Example 1 and line 1) has so rapid a delivery rate that inhibitor is exhausted prematurely, thus terminating the protective action of the cartridge. The preferred delivery rate range is between about turbidity of 8 in 60 minutes to about 20 in 15 minutes.

EXAMPLE 7

To the top of a spool of medium coarse (grade 2) steel wool weighing 3636 grams was added a solution containing 500 grams of Carbowax 1540 dissolved in 500 mls methanol. The methanol was allowed to evaporate, then a solution of 300 grams of a 50/50 by volume mixture of Rodine 213, a Mannich reaction product of an abietyl amine, ketone and formaldehyde plus surfactants commercially available from Amchem Co., and Armohib 31, an ethoxylated amine, dibutyl thiourea and surfactant solubilizer available from Armak Industrial Chemicals, added to 200 grams of Hypol FHP 2000 dissolved in 100 mls of acetone was poured uniformly over the top of the spool. After evaporation of the acetone the spool was assembled with other components in a silver recovery cannister, which was sealed. The cannister was placed in service for recovering silver from the effluent of a graphic arts film processor, and monitored with silver-estimating paper. Detection of silver in the discharge occurred after 150 days.

EXAMPLE 8

To the bottom of a spool of 3500 grams of medium (grade 1) steel wool was added 200 grams of Carbowax 1540, a polyoxyethylene commercially available from Union Carbide, dissolved in 200 mls of methanol. The methanol was allowed to evaporate, whereupon a mixture of 100 grams of a 50/50 by volume combination of Rodine 213 and Armohib 31 and 40 grams of Hypol FHP 2000 dissolved in 28 mls of acetone also was poured uniformly over the bottom of the tapered steel wool spool.

The acetone was allowed to evaporate, the spool was assembled in a cannister and put in service following a graphic arts processor as in Example 7. Detection of silver in the discharge occurred after 330 gallons had passed through the cannister and a service life of 203 days.

EXAMPLE 9

To a silver recovery cannister containing 3544 grams of medium coarse steel wool in a spool was added a "do-nut" shaped cylinder 27.9 cm in diameter and 1.9 cm high which was fabricated by mixing 400 grams of a 50/50 by volume mixture of Rodine 213 and Armohib 31 into an incipiently forming foam from the reaction of 200 grams of a hydrophilic polyurethane prepolymer with 200 grams of water, the whole mix then being poured into a circular mold for setting. The cannister was put into service to recover silver from the effluent of an x-ray film processor and monitored regularly with silver indicating paper. After 18 months the cannister was removed from operation and assayed for its silver content. It contained 119.3 troy ounces of silver. This contrasts with only 1½ to 2 months of service and an average of 50 troy ounces recovered in a similar application for cannisters which do not contain a means for controlled delivery of corrosion inhibitor according to the practice of the present invention.

What is claimed is:

1. A method for controlled delivery of corrosion inhibitors to a silver containing solution in a silver recovery device which utilizes a metallic filler for electron exchange comprising the step of placing a polyurethane foam structure, which has incorporated therein a corrosion inhibitor, into the silver recovery device where the metallic filler contacts with the dormant silver solution, said structure being capable of releasing the corrosion inhibitor at a rate which yields a turbidity within the range of approximately 8 in 60 minutes to 20 in 15 minutes.

2. A method for controlled delivery of corrosion inhibitors in accordance with claim 1 wherein said polyurethane foam is hydrophilic.

3. A method for controlled delivery of corrosion inhibitors in accordance with claim 1 wherein said polyurethane foam structure is a disk having a centrally disposed hole therethrough for positioning said disk in said silver recovery device.

4. A method for controlled delivery of corrosion inhibitors to a silver containing solution in a silver recovery device which utilizes a metallic filler for electron exchange comprising the step of placing a metallic filler for electron exchange which has been coated with a polyurethane prepolymer which has incorporated therein a corrosion inhibitor, foaming said prepolymer on said coated portion of the metallic filler by exposing said prepolymer to $H_2O$, said formed metallic filler releasing said corrosive inhibitor into the silver solution which yields a turbidity within the range of approximately 8 in 60 minutes to 20 in 15 minutes.

5. A method for controlled delivery of corrosion inhibitors in accordance with claim 4 wherein said polyurethane foam is hydrophilic.

* * * * *